United States Patent [19]

Watson et al.

[11] Patent Number: 4,858,687

[45] Date of Patent: Aug. 22, 1989

[54] NON-ROTATING PLUG SET

[75] Inventors: Brock W. Watson; T. Austin Freeman, both of Duncan, Okla.

[73] Assignee: Halliburton Company, Duncan, Okla.

[21] Appl. No.: 266,413

[22] Filed: Nov. 2, 1988

[51] Int. Cl.[4] ..... E21B 33/16

[52] U.S. Cl. ..... 166/153; 166/156; 166/192

[58] Field of Search ..... 166/192, 153, 154, 155, 166/156, 202, 242, 291, 117

[56] References Cited

U.S. PATENT DOCUMENTS

| | | | |
|---|---|---|---|
| 4,175,619 | 11/1979 | Davis | 166/291 |
| 4,190,111 | 2/1980 | Davis | 166/153 |
| 4,190,112 | 2/1980 | Davis | 166/291 |

*Primary Examiner*—Stephen J. Novosad
*Assistant Examiner*—Terry Lee Melius
*Attorney, Agent, or Firm*—James R. Duzan

[57] ABSTRACT

The plug set of the present invention comprises an upper plug having a non-rotation insert retained therein and a lower plug having two non-rotation inserts retained therein. The present invention further includes the use of a non-rotation insert in the floating equipment with which the plug set of the present invention is used.

11 Claims, 2 Drawing Sheets

NON-ROTATING PLUG SET

BACKGROUND OF THE INVENTION

This invention is directed to an improved non-rotating plug set for use in cementing the casing in well bores.

Previously, a plug set and the residual cement in the casing cemented in a well bore were removed by drilling operations using tooth-type rock bits. The teeth on the rock bit proved effective in the drilling of the plug set, even though the individual plugs of the plug set were free to rotate with respect to each other and the floating equipment.

However, with the advent of polycrystalline diamond compact (PDC) drill bits to drill out the plug set and the residual cement in the casing cemented in a well bore it has become necessary to use a non-rotating plug set during the well casing cementing process to facilitate the drilling of the plug set and residual cement. For whatever reasons, the teeth on the PDC drill bit does not as effectively drill through the conventional plug set used in casing cementing operations as the conventional tooth-type rock bit. However, with the use of a non-rotating plug set in casing cementing operations, the PDC drill bit can drill through the plug set, residual cement and floating equipment in time periods comparable to that of conventional tooth-type rock bits.

A prior art non-rotating plug set as set forth in U.S. patent application Ser. No. 07/272,608, filed on Nov. 16, 1988, utilizes an insert in the upper plug of the plug set which has a portion thereof engaging recesses in a portion of the lower plug and an insert in the lower plug to abut a portion of a piece of conventional floating equipment.

BRIEF STATEMENT OF THE INVENTION

The present invention is directed to an improved non-rotating plug set for use in cementing the casing in well bores. The plug set of the present invention comprises an upper plug having a non-rotation insert retained therein and a lower plug having two non-rotation inserts retained therein. The present invention further includes the use of a non-rotation insert in the floating equipment with which the plug set of the present invention is used.

The present invention will be better understood when the drawings of the present invention is taken in conjunction awith the description of the invention hereafter.

DESCRIPTION OF THE INVENTION

Figure 1:
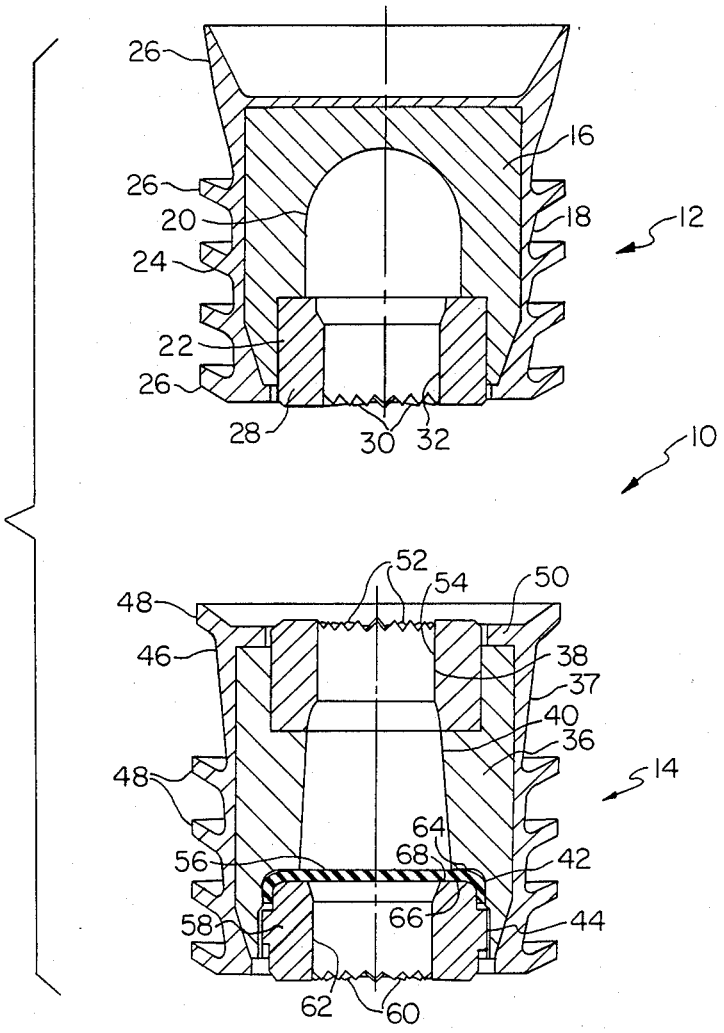
FIG. 1 is a cross-sectional view of the plug set of the present invention.

Referring to FIG. 1, the plug set 10 of the present invention is shown.

The plug set 10 of the present invention comprises an upper plug 12 and lower plug 14.

The upper plug 12 comprises a body member 16 having, in turn, a generally cylindrical exterior surface 18, first interior cavity 20 and second interior cavity 22, elastomeric wiper covering 24 having, in turn, a plurality of wipers 26 thereon, and annular anti-rotation insert 28 having, in turn, a plurality of teeth 30 formed on one end thereof and bore 32 therethrough. The body member 16 may be formed of any suitable, easily drillable material, such as plastic, aluminum, etc. Similarly, the anti-rotation insert 28 may be formed of any suitable, easily drillable material, such as plastic, aluminum, etc. The anti-rotation insert 28 may be retained within the second cavity 22 of the body member 16 by any suitable means, such as adhesive bonding, threaded engagement, etc. The teeth 30 may be formed on the anti-rotation insert 28 by any suitable means, such as machining, molding, etc., if the the insert 28 is molded plastic, etc.

The lower plug 14 comprises a body member 36 having, in turn, a generally cylindrical exterior surface 37 and, on the interior, first bore 38, second bore 40, third bore 42 and fourth bore 44, elastomeric wiper covering 46 having, in turn, a plurality of wipers 48 thereon, annular upper annular anti-rotation insert 50 having, in turn, a plurality of teeth 52 on one end thereof and bore 54 therethrough, elastomeric diaphragm 56 and annular bottom annular anti-rotation insert 58 having, in turn, teeth 60 on one end thereof and bore 62 therethrough.

As with the upper plug 12, the lower plug 14 may have the body member 36 and upper 50 and lower 58 anti-rotation inserts formed of any suitable material, such as plastic, aluminum, etc. Similarly, the upper 50 and lower 58 anti-rotation inserts may be retained within the first bore 38 and fourth bore 44 of the body member 36 by any suitable means, such as adhesive bonding, threaded engagement, etc. Also, the teeth 52 and 60 on the upper 50 and lower 58 anti-rotation inserts respectively, may be formed thereon by any suitable means, such as machining, molding, etc.

The elastomeric diaphragm 56 is retained within the body member 36 of the lower plug 14 by clamping the diaphragm 56 between the shoulder 64 of body member 36 having, in turn, an annular rib thereon and upper end 66 of lower anti-rotation insert 58 with an annular rib 68 on the upper end 66 biting into the diaphragm 56.

Figure 2:
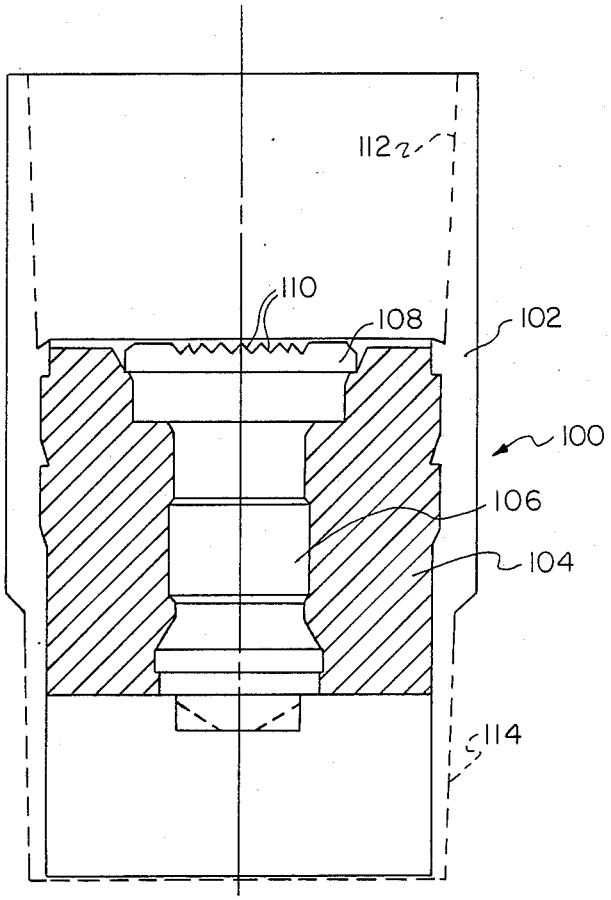
FIG. 2 is a cross-sectional view of a float collar, a typical piece of floating equipment, for use with the plug set of the present invention.

Referring to FIG. 2, a typical float collar 100 for use with the plug set 10 is shown. The float collar 100 comprises an annular housing 102, cementitious material 104, and float valve assembly 106 having anti-rotation insert member 108 thereon having, in turn, a plurality of teeth 110 thereon.

It should be noted that the configuration of the teeth 30 of anti-rotation insert 28 of upper plug 12 and the teeth 52 of upper anti-rotation insert 50 of lower plug 14 geometrically match as well as the teeth 60 of lower anti-rotation insert 58 of lower plug 14 and the teeth 110 of insert member 108 of float collar 100. It should also be appreciated that the geometry of the various teeth 30, 52, 60 and 110 is such that, when engaged, the torsional shear area is equal to one hundred percent (100%) of the cross-sectional area of the respective insert containing the teeth thereby providing greater torsional resistance to rotating.

Additionally, it should be appreciated that although a float collar 100 has been shown, any suitable piece of floating equipment, such as a float shoe assembly, may be used with the plug set 10 so long as the floating equipment includes an anti-rotation insert 108 to engage the lower anti-rotation insert 58 of the lower plug 14.

OPERATION OF THE INVENTION

Referring to FIGS. 1 and 2, the float collar 100 is assembled into a string of casing (not shown) to be connected into a well bore by the threaded bore 112 and threaded surface 114 threadedly engaging the casing.

When it is desired to cement the string of casing having the float collar 100 therein in the well bore, the lower plug 14 of the plug set 10 is pumped through the casing by cement until it lands on the cementitious material 104 and float valve assembly 108 of the float collar 100 with the teeth 60 of the lower anti-rotation insert 58 engaging the teeth 110 of the anti-rotation insert 108 of float collar 100. As the lower plug 14 is pumped through the casing, the outer wiper covering 46 wipes drilling fluid from the interior of the casing string.

After the lower plug 14 has landed on the float collar 100, the pressure of the cement being pumped behind the lower plug 14 is increased until the pressure ruptures the elastomeric diaphragm 56 of the lower plug 14 allowing cement to be pumped therethrough.

After the desired amount of cement has been pumped through the casing, lower plug 14 and float collar 100, the upper plug 12 is pumped through the casing having the elastomeric wiper covering 24 thereon wiping cement from the casing until the upper plug 12 lands on the lower plug 14 having the teeth 30 of the anti-rotation insert 28 of the upper plug 12 engaging the teeth 52 of upper anti-rotation insert 50 of the lower plug 14.

After a suitable waiting period for the cement to set, a drill bit is then lowered through the casing to drill out the upper plug 12, lower plug 14, cementitious material 104 and float valve assembly 106.

It will be appreciated that since the teeth 30 of anti-rotation insert 20 of upper plug 12 engage the teeth 52 of upper anti-rotation insert 50 of lower plug 14 and the teeth 60 of lower anti-rotation insert 58 of plug 14 engage teeth 110 of insert 108 of float collar 100, rotation of the plug set 10 is minimized during the drilling process thereby reducing the amount of drilling time required.

It will be appreciated also that during well cementing operations, only the upper plug 12 of the plug set 10 may be used or multiple lower plugs 14 of the plug set 10 may be used, if desired.

Having thus described my invention, I claim:

1. In combination an anti-rotation plug set and piece of floating equipment for use therewith, wherein the anti-rotation plug set comprises: an upper plug including:

a body member having a cavity in the bottom thereof;

an elastomeric wiper covering disposed about a portion of the body member and retained thereon; and an anti-rotation insert retained within the cavity in the bottom of the body member, the insert having a plurality of downwardly facing teeth thereon; and a bottom plug including:

a body member having a bore therethrough;

an elastomeric wiper covering disposed about a portion of the body member and retained thereon;

an upper anti-rotation insert retained within the upper portion of the bore through the body member, the upper anti-rotation insert having a plurality of upwardly facing teeth thereon adapted to engage the downwardly facing teeth on the anti-rotation insert retained within the upper plug;

a diaphragm sealing the bore through the body member, the diaphragm located below the upper anti-rotation insert in the body member; and a lower anti-rotation insert retained within the lower portion of the bore through the body member, the lower anti-rotation insert having a plurality of downwardly facing teeth thereon; and wherein the piece of floating equipment comprises:

an annular housing;

a float valve assembly;

cementitious material retaining the float valve assembly within the annular housing; and an anti-rotation insert secured within the annular housing, the anti-rotation insert having a plurality of upwardly facing teeth thereon adapted to engage the downwardly facing teeth on the lower anti-rotation insert of the lower plug of the plug set.

2. The combination of claim 1 wherein:

the body member of the upper plug and the anti-rotation insert are formed of plastic.

3. The combination of claim 1 wherein:

the body member of the lower plug, the upper anti-rotation insert and the lower anti-rotation insert are formed of plastic.

4. The combination of claim 1 wherein:

the body member of the upper plug and the anti-rotation insert are formed of aluminum.

5. The combination of claim 1 wherein:

the body member of the lower plug, the upper anti-rotation insert and the lower anti-rotation insert are formed of aluminum.

6. The combination of claim 1 wherein: the anti-rotation insert of the piece of floating equipment is formed of plastic.

7. The combination of claim 1 wherein:

the anti-rotation insert of the piece of floating equipment is formed of aluminum.

8. The combination of claim 1 wherein:

the teeth of the anti-rotation insert of the upper plug when the engaged with the teeth of the upper anti-rotation insert of the lower plug and the teeth of the lower anti-rotation insert when engaged with the teeth of the anti-rotation insert of the piece of floating equipment provide a torsional shear area of material which is equal to one hundred percent of the cross-sectional area of the respective insert containing the teeth.

9. The combination of claim 1 wherein:

the anti-rotation insert of the upper plug and the upper and lower anti-rotation inserts of the lower plug are adhesively bonded to the respective body member of the upper plug and body member of the lower plug.

10. The combination of claim 1 wherein:

the anti-rotation insert of the upper plug and the upper and lower anti-rotation inserts of the lower plug are threadedly engaged with the respective body member of the upper plug and body member of the lower plug.

11. The combination of claim 1 wherein:

the combination of an anti-rotation plug set and piece of floating equipment for use therewith are drilled using a polycrystalline diamond compact bit.

* * * * *